United States Patent [19]

Lewin et al.

[11] Patent Number: 4,564,888

[45] Date of Patent: Jan. 14, 1986

[54] WALL-WASH LIGHTING FIXTURE

[75] Inventors: Ian Lewin, Scottsdale; Richard V. Heinisch, Phoenix; Arnold L. Tanunliong, Tempe, all of Ariz.

[73] Assignee: Linear Lighting Corp., Long Island, N.Y.

[21] Appl. No.: 675,955

[22] Filed: Nov. 28, 1984

[51] Int. Cl.[4] ..... F21V 7/00

[52] U.S. Cl. ..... 362/147; 362/260; 362/296; 362/348

[58] Field of Search ..... 362/125, 151, 241, 243, 362/245, 246, 260, 290, 301, 347, 348, 145, 147, 296, 297

[56] References Cited

U.S. PATENT DOCUMENTS

| | | | |
|---|---|---|---|
| 1,779,591 | 10/1930 | Erikson | 362/341 |
| 3,382,357 | 5/1968 | Welty | 362/347 |
| 3,568,177 | 3/1971 | Hasler | 362/243 |
| 3,643,089 | 2/1972 | Marantz | 362/217 |
| 3,700,877 | 10/1972 | Wilson | 362/246 |
| 3,717,781 | 2/1973 | Sadoski et al. | 313/109 |
| 4,218,727 | 8/1980 | Shemitz et al. | 362/290 |
| 4,229,779 | 10/1980 | Bilson et al. | 362/348 |
| 4,236,193 | 11/1980 | Brandt | 362/241 |
| 4,242,725 | 12/1980 | Douma et al. | 362/341 |
| 4,293,901 | 10/1981 | Hernandez | 362/348 |
| 4,336,576 | 6/1982 | Crabtree | 362/240 |
| 4,349,866 | 9/1982 | Molnar | 362/263 |
| 4,379,322 | 4/1983 | Kelly | 362/301 |
| 4,383,289 | 5/1983 | Lewin | 362/33 |

*Primary Examiner*—Craig R. Feinberg
*Assistant Examiner*—David A. Okonsky
*Attorney, Agent, or Firm*—LaValle D. Ptak

[57] ABSTRACT

A "wall-wash" lighting fixture is mounted on the ceiling along the top of a wall to be provided with a substantially uniform illumination downwardly from the fixture. An elongated fluorescent bulb is used as the source of light; and the reflector is comprised of at least a central section and two shorter end sections. The cross-section of the central section of the reflector differs from the cross-section of the end sections in a manner to cause greater amounts of light to be reflected a greater distance downwardly on the wall from the center section than from the end sections. This compensates for the non-uniform light intensity from the fluorescent bulb, and results in a more uniform illumination of the wall below the fixture.

12 Claims, 6 Drawing Figures

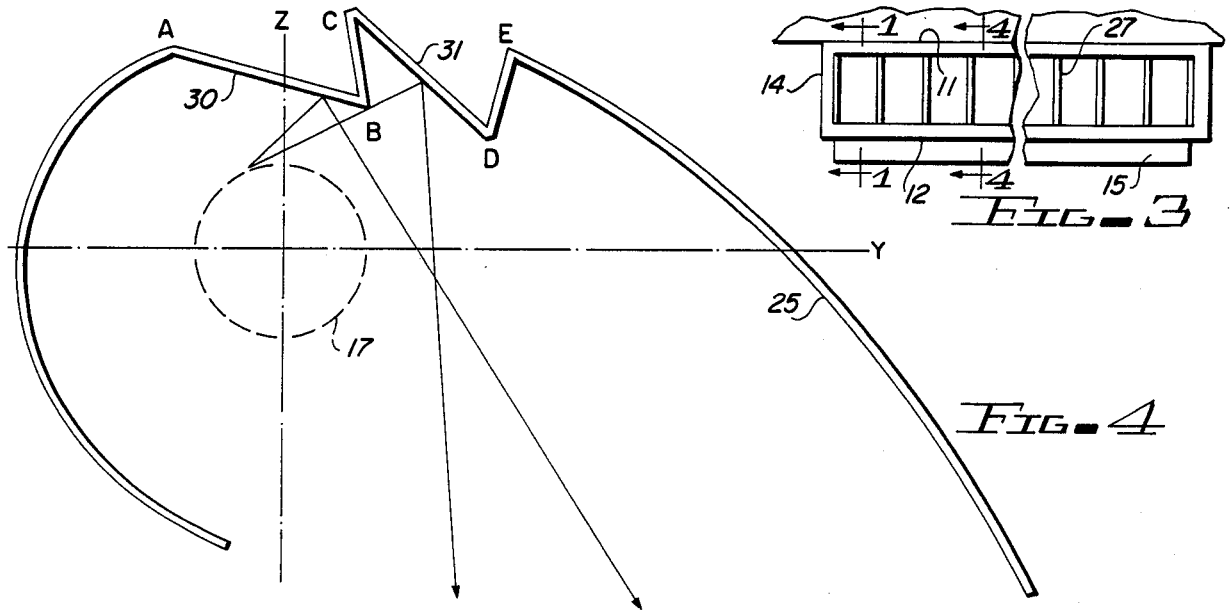
FIG. 3
FIG. 4
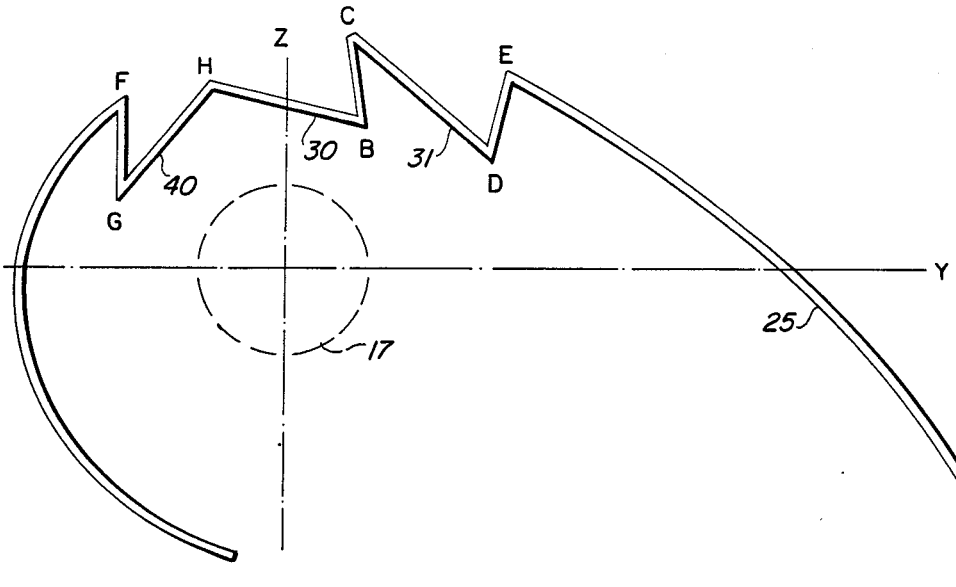
FIG. 5
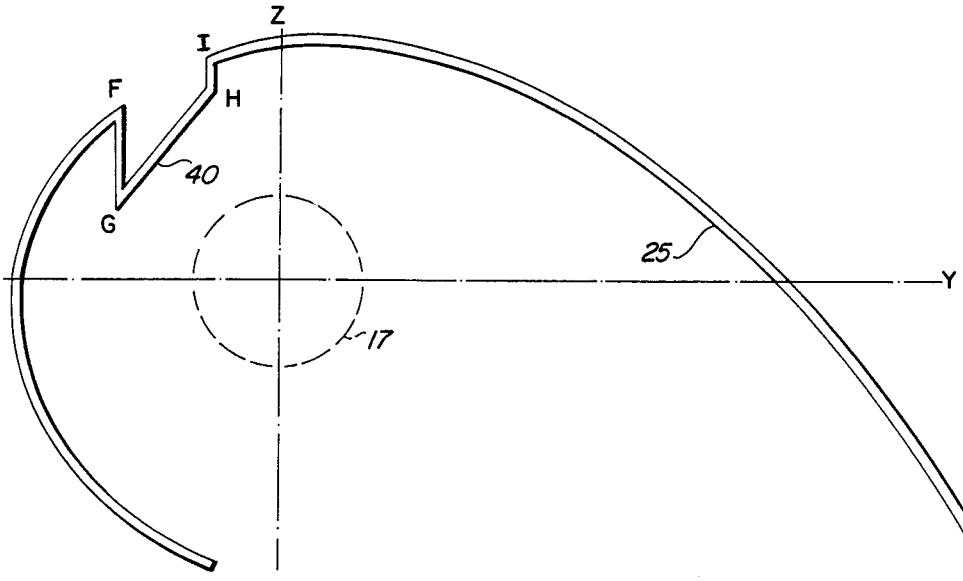
FIG. 6

WALL-WASH LIGHTING FIXTURE

BACKGROUND OF THE INVENTION

Architectural lighting fixtures for retail stores, hotel lobbies, and the like, have been designed for placement along the upper edge of a wall at the juncture of the wall and ceiling for providing a "washing" light effect downwardly from the fixture along the vertical wall surface. For the most desirable results, the brightness or intensity of the light emanating from the fixture along the wall should be uniform along the entire length of the wall and, to the extent possible, from top to bottom.

Uniformity of wall-wash lighting fixtures along the wall length has been difficult to achieve. Primarily this is because of the fact that the bulbs which are used generally are fluorescent bulbs of four foot length (a readily available commercial, standard length). Consequently, a number of fixtures needs to be placed end-to-end to provide illumination of an entire wall surface. At the junctures of the fixtures, there generally is a darker area. Also, fluorescent bulbs emit less light near their ends than at the center. As a consequence, most "wall-wash" lighting fixtures produce a somewhat uneven distribution of light along the wall, creating a type of "scalloped" effect of brighter and darker regions. This is most noticeable directly beneath the fixture itself.

It also has been a problem with prior art lighting fixtures for producing the "wall-wash" effect, that the light intensity rapidly becomes less a short distance down the wall. Part of this is due to the fact that, for aesthetic purposes, the fixtures must be mounted as close as possible to the juncture of the wall and the ceiling; and reflection of light from the fixture to the mid-point and lower points of the wall has been difficult to achieve.

Standard wall-wash fixtures employ a generally shallow rectangular housing which has an elongated rectangular opening along the wall and slightly off-set from the center of the housing. The bulb tupically is located above the edge of the opening which is farthest from the wall, and a uniform curved elongated reflector section is placed behind the bulb. Such a reflector section usually is in the form of a continuous compound curve. The "scalloped" lighting effect, mentioned above, is a result of such reflector which has been tolerated in the past.

Other approaches to providing a uniform illumination of a planar surface, such as a wall or ceiling, have been made. One such approach is disclosed in the patent to Molnar, U.S. Pat. No. 4,349,866. This patent discloses an indirect lighting fixture utilizing an HID bulb in combination with a reflector having combined curved and flat reflector sections throughout its length. This fixture is designed to obtain a uniform illumination of a ceiling, but it is capable of only a relatively narrow band of illumination and does not provide any suggestion as to how an entire wall surface, or ceiling surface, can be evenly and uniformly illuminated.

A lighting fixture which is used to direct light to a location off-set from the fixture, is disclosed in U.S. Pat. No. 4,383,289 to Lewin. This fixture employs a U-shaped floursecent bulb of a relatively short length and a specialized reflector to illuminate a work area located below and off to one side of the fixture. The fixture reflector is a uniform compound curved cross-section reflector of a type somewhat similar to those used in the prior art wall-wash reflectors discussed above.

Other attempts to obtain specialized light patterns or spread of light from a fixture by use of non-uniform reflector sections, are disclosed in the patents to Welty, No. 3,382,357 and Erikson, No. 1,779,591. The Welty patent discloses a street lighting luminaire, which has a number of scalloped, longitudinally extending panels, located above the bulb, to reflect the light to corresponding opposite panel sections, and then in a double reflection out from the fixture to spread the light. The double reflection, of course, significantly reduces the efficiency of the fixture. In addition, the object of this fixture is to produce a pre-established pattern of light on the ground beneath the fixture and it is not intended for illuminating a wall surface which is perpendicular to the surface on which the fixture is mounted.

The Erikson patent is for a showcase reflector and has uniform reflector sections located behind the bulb, extending along its length. No compensation for non-uniform light intensity from the bulb is made.

A patent which is directed to a fixture for illuminating a vertical wall surface from above, is U.S. Pat. No. 3,643,089 to Marantz. The fixture disclosed in this patent, however, is not an elongated wall-wash fixture, but instead, is a complex multiple reflector fixture employing multiple reflections from a generally point-light source to achieve the illumination desired. As a result, the Marantz fixture inherently is limited to walls of relatively short lengths and could not be used to provide anything approaching uniform illumination of a wall of even more than a few feet in length.

It is desirable to provide a wall-wash lighting fixture which overcomes the disadvantages of the prior art mentioned above. It also is desirable to provide such a fixture with the capability of overcoming these disadvantages with minimum departure from the housing configurations presently used for wall-wash lighting fixtures. It further is desirable to provide a wall-wash lighting fixture which is simple to manufacture.

SUMMARY OF THE INVENTION

It is an object of this ivention to provide an improved wall-wash lighting fixture.

It is another object of this invention to provide an improved wall-wash lighting fixture which provides a uniform light intensity along the wall from end-to-end of the fixture.

It is another object of this invention to provide a wall-wash lighting fixture employing reflector sections which compensate for different light intensity along the length of the lamp used as the light source.

In accordance with a preferred embodiment of this invention, a wall-wash lighting fixture for providing uniform light distribution along a flat wall surface from an elongated fluorescent lamp, includes an elongated rectangular housing which has an elongated light emitting opening in it in a plane which is substantially perpendicular to the wall surface to be illuminated. A reflector is placed in the housing and extends the length of the lamp located therein. This reflector comprises first and second end sections which are separated by and connected to a central section. The central reflector section directs a greater percentage of light from the lamp downwardly on the wall to a greater distance than either of the two end sections. Thus, the effect of the light distribution on the wall is of a uniform "washing" of light from the fixture downwardly.

BRIEF DESCRIPTION OF THE DRAWINGS

FIG. 3 is a bottom view of the fixture of FIG. 1;

FIG. 4 is a cross-section taken along the line 4—4 of FIG. 3; and

FIGS. 5 and 6 are cross-sections taken at different points of an alternative embodiment of the invention.

DETAILED DESCRIPTION

Figure 1:
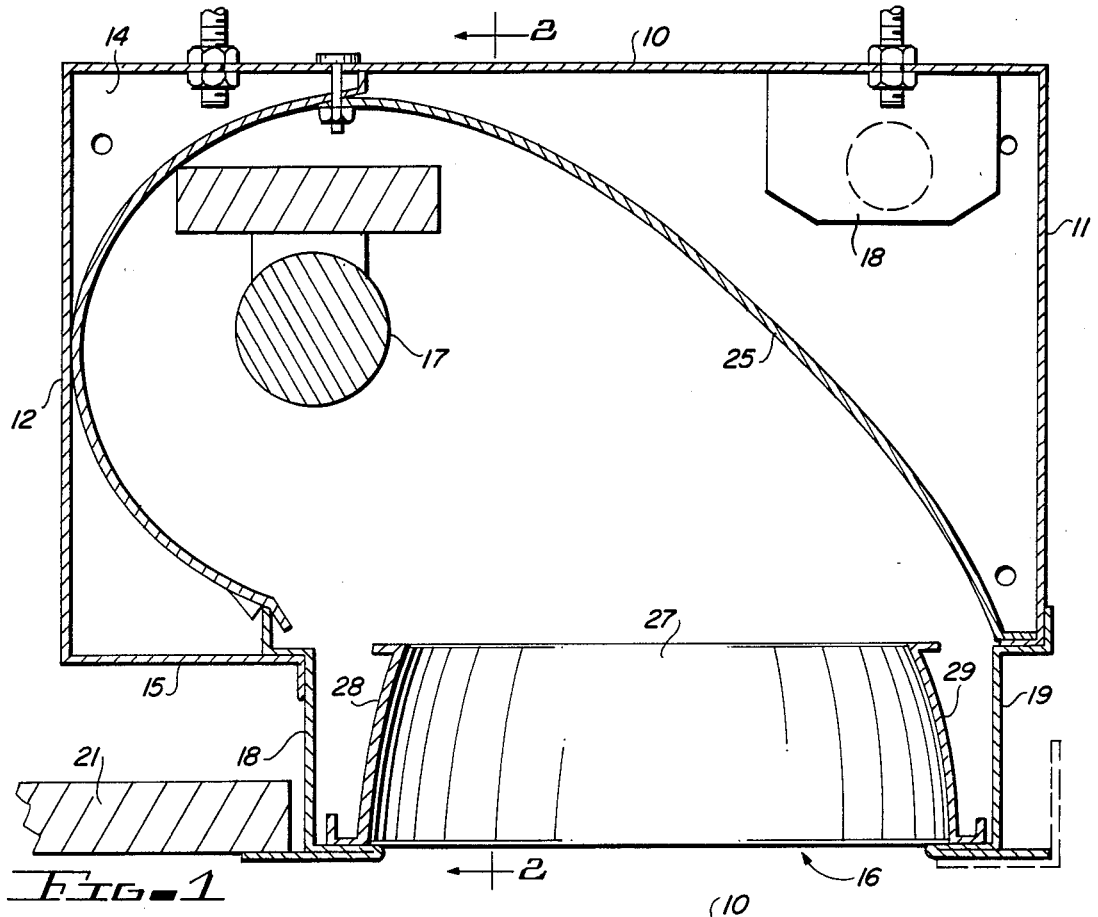
FIG. 1 is a cross-section of a preferred embodiment of the invention, taken near one end of a light fixture.
Figure 2:
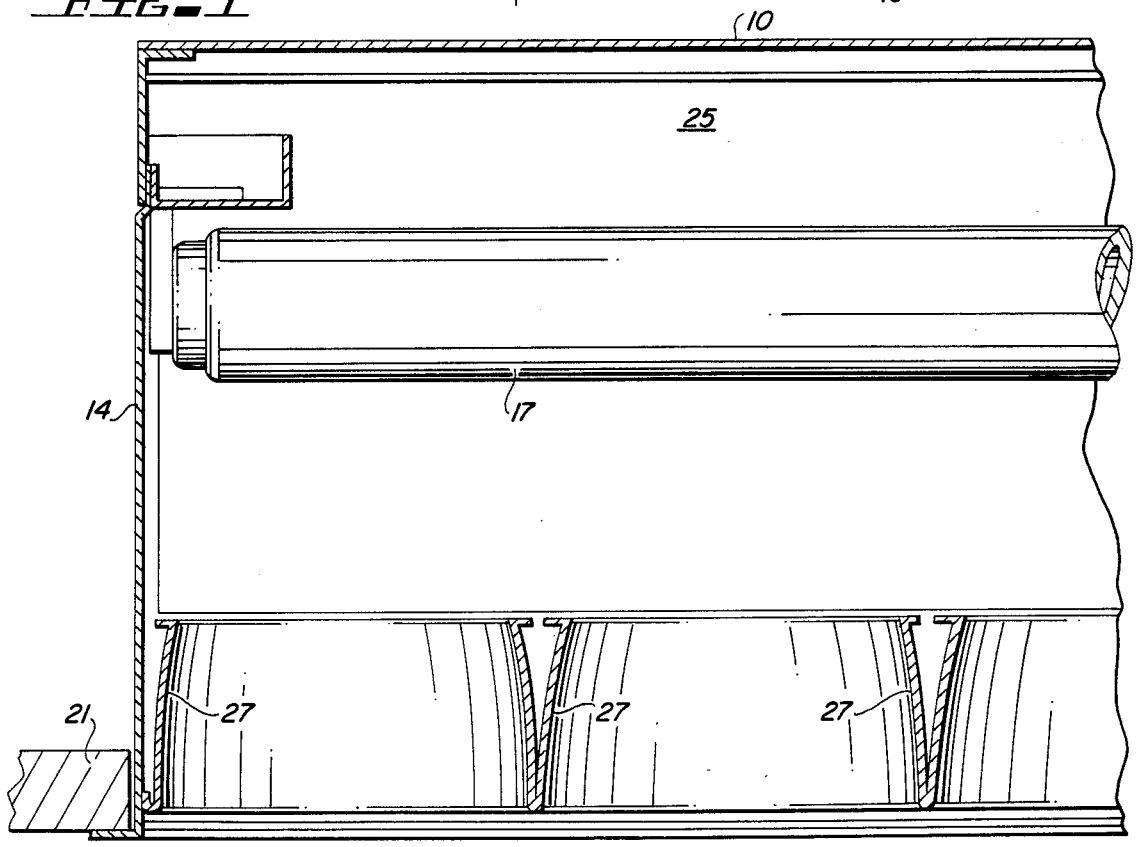
FIG. 2 is a partially cut-away view of the embodiment of FIG. 1 taken along the line 2—2.

Reference now should be made to the drawings in which the same or similar reference numbers are used throughout the different Figures to designate the same or similar components. First, reference should be made to FIGS. 1 and 2 which are cross-sectional views of a portion of a preferred embodiment of the invention. An elongated rectangular box-like housing comprises a top 10 and first and second longitudinal sides 11 and 12, which are closed by a pair of identical end panels, one of which, panel 14, is shown in FIGS. 1 and 2. The lower side of the housing includes a stepped off-set 15 and an elongated rectangular opening 16 at the bottom of the fixture. The opening 16 is in a downwardly depending section including a pair of elongated rectangular panel members 18 and 19, which, along with corresponding portions of the end panels 14, provide the light exit opening of the fixture. The fixture itself is adapted to be mounted as a recessed fixture in the ceiling 21 adjacent the junction of the ceiling at the wall. Alternatively, the fixture may be attached to the ceiling directly rather than recessed. In either event, the panel 11 is placed against the wall (or in alignment with it for a recessed fixture) to cause the edge of the opening defined by the panel member 19 to be as close as possible to the top of the wall which is to be "washed" with light from the fixture.

Light, preferably, is provided by a lamp in the form of a fluorescent light tube 17, typically in a four foot length, although other lengths could be used as well. A four foot length, however, is a commonly use, readily available, standard length for a variety of lighting installations. A ballast 18 for the fluorescent tube 17 is mounted in free space within the fixture, and mounting sockets and an electrical supply are provided in a standard manner for the fluorescent tube 17.

A reflector 25 is mounted within the housing and wraps around the bulb 17, as shown most clearly in FIG. 1. In the portion of the fixture shown in FIGS. 1 and 2, this reflector is in the form of a continuous curve, with the portion to the left of the bulb 17 (as viewed in FIG. 1) being generally in the form of a spiral of Archimedes and then changing to a parabolic reflector section from the portion immediately above the bulb 17 to the point where the reflector terminates above the panel member 19.

The arrangement, as illustrated in the portion of the fixture shown in FIGS. 1 and 2, also comprises the standard reflector configuration which, in the past, has been used throughout the entire length of the four foot fixture to obtain the wall-wash lighting effects. As mentioned previously, when a uniform reflector, having the cross-section of FIG. 1 throughout its length, is used for a wall-wash reflector, the inherent uneveness of the distribution of light from the fluorescent tube 17 causes bright regions to appear on the wall near the center portion of the fixture and darker areas to appear near the ends of the tube 17. The result is a scalloped light effect when a number of these fixtures are placed end-to-end to illuminate or "wash" a wall with light.

To prevent a person standing below the fixture from being able to directly view the bulb 17, it can be seen that the bulb is off-set to the left, as viewed in FIG. 1, to a position substantially directly over the panel member 18. In addition, louvers 27 are spaced at four inch intervals along the length of the fixture across the opening 16 and are held in place by a pair of parabolic end frame members 28 and 29 (shown most clearly in FIG. 1). The louvers 27, in a standard fixture, are in the form of back-to-back parabolic sections as seen most clearly in FIG. 2. The spacing of the louvers is such that at normal viewing angles, the fixture has reduced glare.

Reference now should be made to FIG. 4 in conjunction with FIG. 1. As stated previously, it has been found that when the cross-section of reflector, is used uniform throughout the length of the fixture, the intensity of light which appears on the wall is uneven, or scalloped. This has been found due to the fact that for a four foot bulb 17, substantially more light is emitted from the center thirty-five inches of the bulb, then for the two six and one-half inch sections at the ends. By changing the cross-section of the reflector 25 in this center or middle thirty-five inch section to the configuration shown in FIG. 4, while leaving the six and one-half inch end section in the form shown in FIG. 1, this uneven light distribution, so far as it is viewed on a wall being washed by light from the fixture is concerned, is reduced.

Such a change recognizes two factors. The first of these factors is that the central portion of the bulb 17 emits more light than the end portions of the bulb. The second of these factors is that for a fluorescent bulb, the light source is not solely a line source at the axis of the bulb, but instead, includes emission of tangential light rays from the outer surface of the cylindrical fluorescent tube 17. Consequently, the center thirty-five inch section is changed to the configuration of FIG. 4 by adding two elongated flat reflector segments 30 and 31, which are parallel to the axis of the bulb 17. The segment 30 is located directly above the bulb 17 (as viewed in FIG. 4) with the edge A thereof a greater distance above a horizontal plane passing through the axis of the bulb than the edge B. Similarly, the elongated rectangular reflector section 31 has its edge C, at a higher elevation than the edge D. The edges B and D of the sections 30 and 31 are located on the side of the fixture which faces the wall which is to be washed with light.

A pair of typical light rays emanating from tangents to the surface of the bulb 17, are shown striking the surfaces of the reflector sections 30 and 31 and exiting from the bottom of the reflector. It can be seen that these rays are thrown a substantial distance downwardly onto a wall adjacent the right edge of the reflector (as viewed in FIG. 4). The amount of light reflected to such greater distance downwardly on the wall is greater than from a reflector section in the shape as shown in the cross-section of FIG. 1. As a consequence, the greater intensity of light which, is present from the bulb 17 in this center section, is dispersed over a larger wall area than is the light which emanates from the bulb 17 in the two six and one-half inch end sections of the reflector 25. The end sections, having the cross-sectional configuration of FIG. 1, abut directly against the edges of the central section shown in FIG. 4 to provide a continuous reflector 25, the central section of which, however, has the flat reflector segments 30 and 31 in it. Thus, the reflector 25 for the fixture is not of uniform cross-section throughout its entire length.

In a typical reflector of the type shown for the section in FIG. 4, the fluorescent bulb has a diameter of approximately one and one-half inches. The distance from the axis of the bulb, along a horizontal plane through it, to the point where the left-hand portion of the reflector 25 is located, typically is two and one-half inches. Similarly, the distance from the axis of the bulb to the right, where the dotted horizontal line in FIG. 1 intersects the reflector 25, is approximately four and three-fourths inches. With these parameters, the Y and Z coordinates, (in inches) formed by horizontal and vertical planes respectively, passing through the axis of the bulb 17, for the points A, B, C, D and E are as follows:

| | Y | Z |
|---|---|---|
| A | −1.138 | 1.894 |
| B | 0.759 | 1.397 |
| C | 0.591 | 2.285 |
| D | 1.941 | 1.098 |
| E | 2.150 | 1.870 |

The configuration, which has been described above for FIGS. 1, 2 and 4, has been found highly satisfactory when the parabolic louvers 27 are employed in the fixture. Some fixtures, however, do not use these back-to-back parabolic sections, but instead use flat plate louvers (not shown). When flat plate louvers are used, it has been found that some shadow effect is discernible on the louvers themselves by a person standing beneath the fixture and looking up along the length of the fixture. For some installations this is considered undesirable. To overcome this unwanted "shadowing" of flat louvers, the reflector sections of FIGS. 1 and 4 have may be modified in accordance with the cross-sections shown in FIGS. 5 and 6.

Essentially, the cross-section of FIG. 5 corresponds to and uses the same dimensions as the cross-section shown in FIG. 4. This reflector section of FIG. 5 is used for the central thirty-five inch section of the reflector for the fixture. The two shorter six and one-half inch end sections of the reflector 25 then may be modified from the configuration shown in FIG. 1 to the one shown in FIG. 6. Otherwise, the reflector sections of FIGS. 6 and 5 correspond in every other respect to the to the reflector sections of FIGS. 1 and 4, respectively.

As is readily apparent from an examination of FIGS. 1, 4, 5 and 6, the embodiment illustrated in FIGS. 5 and 6 has an additional elongated flat rectangular reflector section 40 added to it throughout the length of the entire fixture from end-to-end. In the central section of the reflector, as illustrated in FIG. 5, this additional rectangular section 40 has a common edge identifed by the letter H with the rear or left edge of the reflector section 30. In the end sections (on both ends of the bulb 17) this elongated section 40 juts into the otherwise continuous curve reflector 25 in the manner of a flat tooth, as illustrated most clearly in FIG. 6.

For the central reflector section of FIG. 5, the locations of the different edges of the sections, (in inches) as measured from the axis of the bulb 17, are as follows:

| | Y | Z |
|---|---|---|
| F | −1.542 | 1.625 |
| G | −1.542 | 0.771 |
| H | −0.679 | 1.771 |
| B | 0.759 | 1.397 |
| C | 0.591 | 2.285 |
| D | 1.941 | 1.098 |
| E | 2.150 | 1.870 |

For the two identical end sections of FIG. 6 (the six and one-half inch sections of the reflector on each end of the bulb 17) the locations of the different edges in inches of the reflector segment 40, again for a fixture having the overall dimensions mentioned above in conjunction with FIG. 4, are as follows:

| | Y | Z |
|---|---|---|
| F | −1.542 | 1.625 |
| G | −1.542 | 0.771 |
| H | −0.679 | 1.771 |
| I | −0.679 | 2.125 |

The reflector section 40 produces some double reflections of light from the upper left quadrant of the bulb as viewed in FIGS. 1, 4, 5 and 6. These additional reflections cause the light which strikes flat louvers used in place of the louvers 27, to have a substantially uniform intensity, so far as it is viewed from below on the louvers themselves.

The embodiments which have been described above and which are illustrated in the drawings, are to be considered illustrative of the invention and not as limiting. Various changes and modifications will occur to those skilled in the art without departing from the invention. For example, the particular arcs of curvature which are used in the curved sections of the reflector 25 may be varied. Variations may be made in the widths and lengths of the flat elongated reflector segments 30, 31 and in the width of the segment 40, along with some minor variations in the angles at which these segments are located with respect to the axis of the bulb and the opening from the fixture. All such modifications, and others not mentioned here, which will be suggested to those skilled in the art after consideration of the foregoing disclosure, are to be considered as encompassed within the true scope of the invention defined in the claims.

We claim:

1. A lighting fixture for providing substantially uniform light distribution along a flat wall surface from an elongated lamp, including in combination:

a housing having an elongated light emitting opening of a predetermined length therein in a plane substantially perpendicular to the wall surface to be illuminated;

a reflector in said housing extending along said predetermined length of the opening therein and comprising first and second end sections separated by and interconnected to a central section;

means for mounting an elongated lamp in said housing between said reflector and the opening in said housing, whereby said reflector directs light reflected from said lamp mounted in said housing outwardly through the elongated opening in said housing toward the wall surface; and wherein said central section of said reflector has portions thereof structured to direct a greater percentage of light from the lamp downwardly on the wall surface a greater distance than from said end sections.

2. The combination according to claim 1, wherein said housing is an elongated rectangular housing and the opening therein is a rectangular opening.

3. The combination according to claim 1, wherein the cross-section of said reflector, in planes perpendicular to the opening in said housing, is identical throughout said first and second end sections and has at least a portion thereof in said central section which differs from the cross-section of said first and second end sections to effect such direction of a greater percentage of light to such greater distance on the wall surface.

4. The combination according to claim 1, wherein the opening in said housing has first and second spaced-apart edges and cross-sections of said first and second end sections of said reflector, in planes perpendicular to the axis of said elongated lamp, comprise continuous curves in the form substantially of a spiral of Archimedes extending from said first edge of the opening in said housing opposite the wall section to be illuminated, around behind the lamp and continuously expanding into a substantially parabolic curve at a point above the lamp and extending to said second edge of the opening nearest the wall section to be illuminated.

5. The combination according to claim 1, wherein the elongated lamp, to be mounted in said housing, is a fluorescent lamp.

6. The combination according to claim 1, wherein cross-sections of said first and second end sections of said reflector in planes perpendicular to the axis of an elongated lamp mounted in said housing are identical and are substantially a continuous curve, and said central section of said reflector includes an elongated flat strip therein, located above a horizontal plane through the axis of said lamp, for directing increased quantities of light a greater distance downwardly from said lamp to a lower position on a wall adjacent which the lighting fixture is mounted.

7. The combination according to claim 6, wherein said elongated flat strip is positioned to optimize the reflection of tangential light rays from an elongated lamp, edge located farthest from said wall downwardly along said wall, away from the section of said wall immediately adjacent the opening in said housing.

8. The combination according to claim 7, wherein said elongated flat strip comprises at least first and second elongated flat strips at different angles to the vertical to reflect.

9. The combination according to claim 8, wherein said first and second end sections include a further flat elongated strip in an otherwise continuous curved reflector section, said further flat elongated strip being located in said housing diagonally opposite said second edge of the opening in said housing, which is to be located nearest the wall surface.

10. The combination according to claim 9, wherein the lamp is mounted in said housing, in a position off-set from the center of the opening therein, substantially above said first edge of the opening which is opposite the wall surface to be illuminated.

11. The combination according to claim 10, wherein the elongated lamp, to be mounted in said housing, is a fluorescent lamp.

12. The combination according to claim 11 further including louver means in the opening in said housing.

* * * * *